US006322419B1

(12) United States Patent
Dermenci

(10) Patent No.: US 6,322,419 B1
(45) Date of Patent: Nov. 27, 2001

(54) COMBINATION SPINNING TOP AND YO-YO

(76) Inventor: Turgay Dermenci, 10092 Kamuela Dr., Huntington Beach, CA (US) 92646

( * ) Notice: Subject to any disclaimer, the term of this patent is extended or adjusted under 35 U.S.C. 154(b) by 0 days.

(21) Appl. No.: 09/653,302

(22) Filed: Sep. 1, 2000

(51) Int. Cl.[7] ..... A63H 1/08

(52) U.S. Cl. ..... 446/262; 446/261; 446/256; 446/259

(58) Field of Search ..... 446/261, 259, 446/262, 256

(56) References Cited

U.S. PATENT DOCUMENTS

| | | | | |
|---|---|---|---|---|
| D. 31,654 | | 10/1899 | Poteet . | |
| 181,852 | * | 9/1876 | Kern | 446/262 |
| 282,129 | | 7/1883 | Sunderman . | |
| 455,104 | * | 6/1891 | Jimenez | 446/262 |
| 505,969 | | 10/1893 | Travis . | |
| 656,771 | * | 8/1900 | Koscialowski | 446/262 |
| 2,535,157 | | 12/1950 | Radovan . | |
| 2,639,546 | * | 5/1953 | Shockey | 446/262 |
| 3,330,067 | | 7/1967 | Starkenberg . | |
| 3,936,974 | | 2/1976 | House . | |

* cited by examiner

*Primary Examiner*—Jacob K. Ackun, Jr.
*Assistant Examiner*—Urszula M. Cegielnik

(57) ABSTRACT

A combination spinning top and yo-yo for providing a new type of spinning top and yo-yo. The combination spinning top and yo-yo includes a conoidal-shaped member having a top end, a tapered lower portion, and a tip disposed at a bottom end thereof; and also includes a spin inducing assembly for spinning the conoidal-shaped member.

9 Claims, 1 Drawing Sheet

COMBINATION SPINNING TOP AND YO-YO

BACKGROUND OF THE INVENTION

1. Field of the Invention

The present invention relates to a spinning toy and more particularly pertains to a new combination spinning top and yo-yo for providing a new type of spinning top and yo-yo.

2. Description of the Prior Art

The use of a spinning toy is known in the prior art. More specifically, a spinning toy heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,330,067; 2,535,157; U.S. Pat. No. Des. 31,654; U.S. Pat. No. 3,936,974; 282,129; and 505,969.

While these devices fulfill their respective, particular objectives and requirements, the aforementioned patents do not disclose a new combination spinning top and yo-yo. The inventive device includes a conoidal-shaped member having a top end, a tapered lower portion, and a tip disposed at a bottom end thereof; and also includes a spin inducing assembly for spinning the conoidal-shaped member.

In these respects, the combination spinning top and yo-yo according to the present invention substantially departs from the conventional concepts and designs of the prior art, and in so doing provides an apparatus primarily developed for the purpose of providing a new type of spinning top and yo-yo.

SUMMARY OF THE INVENTION

In view of the foregoing disadvantages inherent in the known types of spinning toy now present in the prior art, the present invention provides a new combination spinning top and yo-yo construction wherein the same can be utilized for providing a new type of spinning top and yo-yo.

The general purpose of the present invention, which will be described subsequently in greater detail, is to provide a new combination spinning top and yo-yo which has many of the advantages of the spinning toy mentioned heretofore and many novel features that result in a new combination spinning top and yo-yo which is not anticipated, rendered obvious, suggested, or even implied by any of the prior art spinning toy, either alone or in any combination thereof.

To attain this, the present invention generally comprises a conoidal-shaped member having a top end, a tapered lower portion, and a tip disposed at a bottom end thereof; and also includes a spin inducing assembly for spinning the conoidal-shaped member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination spinning top and yo-yo which has many of the advantages of the spinning toy mentioned heretofore and many novel features that result in a new combination spinning top and yo-yo which is not anticipated, rendered obvious, suggested, or even implied by any of the prior art spinning toy, either alone or in any combination thereof.

It is another object of the present invention to provide a new combination spinning top and yo-yo which may be easily and efficiently manufactured and marketed.

It is a further object of the present invention to provide a new combination spinning top and yo-yo which is of a durable and reliable construction.

An even further object of the present invention is to provide a new combination spinning top and yo-yo which is susceptible of a low cost of manufacture with regard to both materials and labor, and which accordingly is then susceptible of low prices of sale to the consuming public, thereby making such combination spinning top and yo-yo economically available to the buying public.

Still yet another object of the present invention is to provide a new combination spinning top and yo-yo which provides in the apparatuses and methods of the prior art some of the advantages thereof, while simultaneously overcoming some of the disadvantages normally associated therewith.

Still another object of the present invention is to provide a new combination spinning top and yo-yo for providing a new type of spinning top and yo-yo.

Yet another object of the present invention is to provide a new combination spinning top and yo-yo which includes a conoidal-shaped member having a top end, a tapered lower portion, and a tip disposed at a bottom end thereof; and also includes a spin inducing assembly for spinning the conoidal-shaped member.

Still yet another object of the present invention is to provide a new combination spinning top and yo-yo that allows the user to work on one's eye hand coordination while having fun.

Even still another object of the present invention is to provide a new combination spinning top and yo-yo that affordably entertains the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
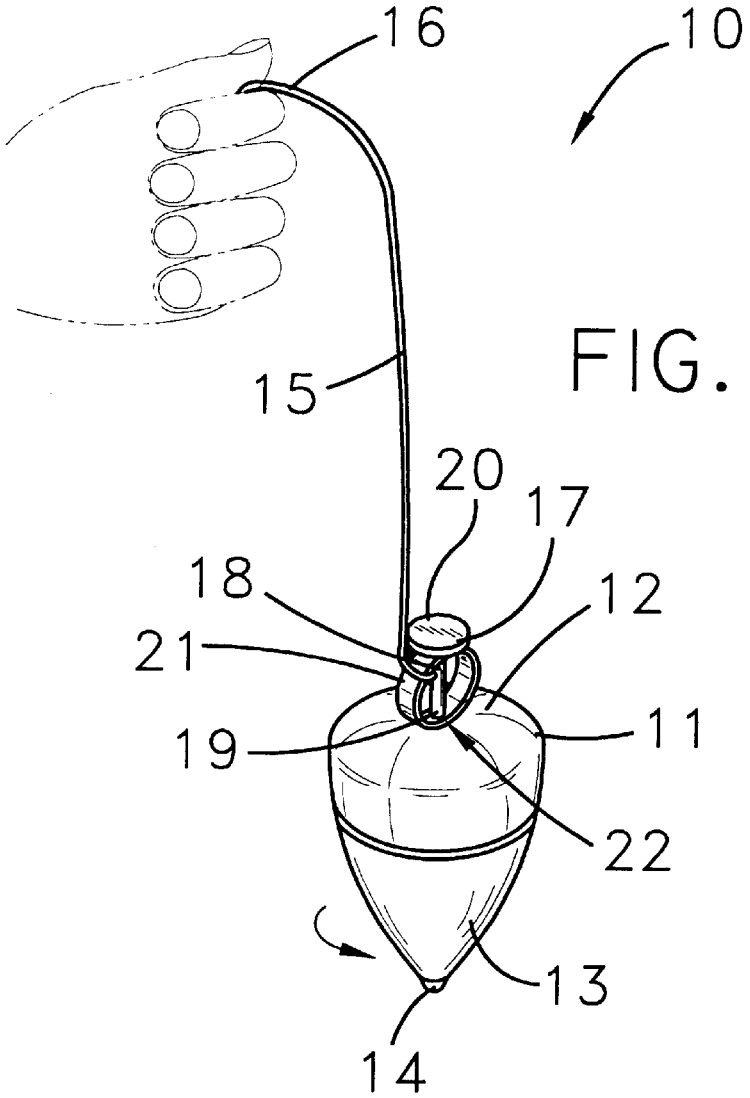
FIG. 1 is a perspective view of a new combination spinning top and yo-yo according to the present invention.
Figure 2:
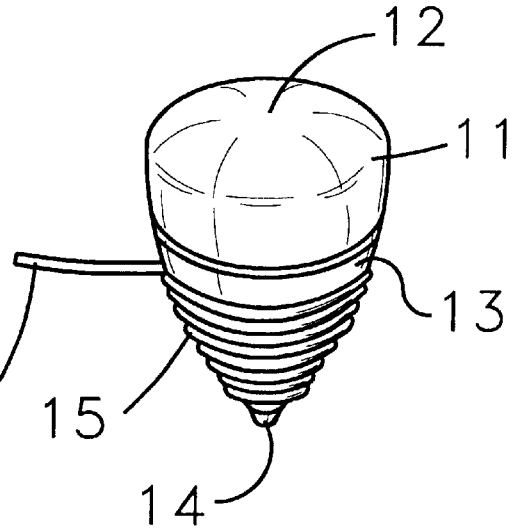
FIG. 2 is a perspective view of a second embodiment of the present invention.

With reference now to the drawings, and in particular to FIGS. 1 through 2 thereof, a new combination spinning top and yo-yo embodying the principles and concepts of the present invention and generally designated by the reference numeral 10 will be described.

As best illustrated in FIGS. 1 through 2, the combination spinning top and yo-yo 10 generally comprises a conoidal-shaped member 11 having a top end 12, a tapered lower portion 13, and a tip 14 conventionally disposed at a bottom end thereof with the conoidal-shaped member 11 having a height of approximately 3 to 4 inches and a diameter of approximately 3 inches.

A spin inducing assembly for spinning the conoidal-shaped member 11 includes a flexible line 15 being woundable about the conoidal-shaped member 11 and being adapted to spin the conoidal-shaped member 11 upon the flexible line 15 being unwound rapidly from about the conoidal-shaped member 11. The flexible line 15 has a free-end portion 16 for grasping by a user to quickly unwind the flexible line 15 from about the conoidal-shaped member 11 to facilitate spinning of the conoidal-shaped member 11. The flexible line 15 is wound about the tapered lower portion 13 of the conoidal-shaped member 11. The spin inducing assembly also includes an elongate ring support member 17 having a first end 18 and a second end 19 which is securely and conventionally attached to and extends outwardly of the top end 12 of the conoidal-shaped member 11, and further includes a ring member 21 being rotatably mounted to the elongate ring support member 17. The flexible line 15 has an end which is securely attached to the ring member 21 for rotation therewith. The elongate ring support member 17 also includes a head portion 20 at the first end 18 thereof with the ring member 21 being disposed between the head portion 20 and the top end 12 of the conoidal-shaped member 11. The ring member 21 includes diametrically-opposed holes 22 disposed therethrough with the elongate ring support member 17 being extended through the diametrically-opposed holes 22.

In use, the user winds the flexible line 15 about the tapered lower portion 13 of the conoidal-shaped member 11 with the flexible line 15 being attached to the ring member 21. The user pulls on the free-end portion 16 of the flexible line 15 quickly to unwind the flexible line 15 from about the conoidal-shaped member 11 which causes the conoidal-shaped member 11 to rotate and spin upon the tip 14 and which also causes the flexible line 15 to spin with the ring member 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination spinning top and yo-yo comprising:

a conoidal member having a top end, a tapered lower portion, and a tip disposed at a bottom end thereof;

a spin inducing assembly for spinning said conoidal member;

wherein said spin inducing assembly includes a flexible line being windable about said conoidal member and being adapted to spin said conoidal member upon said flexible line being unwound from about said conoidal member;

wherein said flexible line has a free-end portion for grasping by a user to quickly unwind said flexible line from about said conoidal member to facilitate spinning of said conoidal member;

wherein said flexible line is wound about said tapered lower portion of said conoidal member; and an elongate ring support member having a first end and a second end which is securely attached to and extends outwardly of said top end of said conoidal member, and further includes a ring member being rotatably mounted to said elongate ring support member, said flexible line having an end which is securely attached to said ring member for rotatation therewith.

2. A combination spinning top and yo-yo as described in claim 1, wherein said elongate ring support member also includes a head portion at said first end thereof with said ring member being disposed between said head portion and said top end of said conoidal member.

3. A combination spinning top and yo-yo as described in claim 1, wherein said ring member includes diametrically-opposed holes disposed therethrough with said elongate ring support member being extended through said diametrically-opposed holes.

4. A combination spinning top and yo-yo comprising:

a conoidal member having a top end, a tapered lower portion, and a tip disposed at a bottom end thereof, said conoidal member having a height of approximately 3 to 4 inches and a diameter of approximate 13 inches; and a spin inducing assembly for spinning said conoidal member including a flexible line being windable about said conoidal member and being adapted to spin said conoidal member upon said flexible line being unwound from about said conoidal member, said flexible line having a free-end portion for grasping by a user to quickly unwind said flexible line from about said conoidal member to facilitate spinning of said conoidal member, said flexible line being wound about said tapered lower portion of said conoidal member, said spin inducing assembly also including an elongate ring support member having a first end and a second end which is securely attached to and extends outwardly of said top end of said conoidal member, and further including a ring member being rotatably mounted to said elongate ring support member, said flexible line having an end which is securely attached to said ring member for rotatation therewith, said elongate ring support member also including a head portion at said first end thereof with said ring member being disposed between said head portion and said top end of said conoidal member, said ring member including diametrically-opposed holes disposed therethrough with said elongate ring support member being extended through said diametrically-opposed holes.

5. A combination spinning top and yo-yo comprising:

a conoidal member having a top end, a tapered lower portion, and a tip disposed at a bottom end thereof;

a spin inducing assembly for spinning said conoidal member;

wherein said spin inducing assembly includes a flexible line being windable about said conoidal member and being adapted to spin said conoidal member upon said flexible line being unwound from about said conoidal member; and wherein said spin inducing assembly also includes an elongate ring support member having a first end and a second end which is securely attached to and extends outwardly of said top end of said conoidal member, and further includes a ring member being rotatable mounted to said elongate ring support member, said flexible line having an end which is securely attached to said ring member for rotatation therewith.

6. A combination spinning top and yo-yo as described in claim 5, wherein said flexible line has a free-end portion for grasping by a user to quickly unwind said flexible line from about said conoidal member to facilitate spinning of said conoidal member.

7. A combination spinning top and yo-yo as described in claim 5, wherein said flexible line is wound about said tapered lower portion of said conoidal member.

8. A combination spinning top and yo-yo as described in claim 5, wherein said elongate ring support member also includes a head portion at said first end thereof with said ring member being disposed between said head portion and said top end of said conoidal member.

9. A combination spinning top and yo-yo as described in claim 5, wherein said ring member includes diametrically-opposed holes disposed therethrough with said elongate ring support member being extended through said diametrically-opposed holes.

* * * * *